US007097414B2

(12) United States Patent
Stangeland

(10) Patent No.: US 7,097,414 B2
(45) Date of Patent: Aug. 29, 2006

(54) INDUCER TIP VORTEX SUPPRESSOR

(75) Inventor: Maynard L. Stangeland, Thousand Oaks, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 0 days.

(21) Appl. No.: 10/737,585

(22) Filed: Dec. 16, 2003

(65) Prior Publication Data

US 2005/0129500 A1 Jun. 16, 2005

(51) Int. Cl.
*F04D 27/02* (2006.01)

(52) U.S. Cl. ..... 415/58.4; 415/183; 415/186; 415/914

(58) Field of Classification Search ..... 415/57.1, 415/57.2, 57.4, 58.4, 58.5, 116, 119, 183, 415/186, 143, 914
See application file for complete search history.

(56) References Cited

U.S. PATENT DOCUMENTS 3,307,776 A 3/1967 White
5,762,034 A * 6/1998 Foss ..... 123/41.49
6,244,817 B1 * 6/2001 Ngo ..... 415/119
6,379,110 B1 * 4/2002 McCormick et al. ..... 415/119
2002/0192073 A1 12/2002 Japikse

FOREIGN PATENT DOCUMENTS

DE 3524297 1/1987
EP 0 606 475 7/1994

* cited by examiner

*Primary Examiner*—Edward K. Look
*Assistant Examiner*—Dwayne J White

(57) ABSTRACT

Embodiments of the invention provide a method, device, and turbopump configured to suppress higher order cavitations at an inducer tip in a turbopump. An inducer having a tip is rotated, and a first flow is induced axially through the inducer at a first velocity. A second fluid flow is introduced toward a tip of the inducer substantially parallel to the first fluid flow at a second velocity that is greater than the first velocity, such that back flow through the tip of the inducer is reduced.

28 Claims, 4 Drawing Sheets

INDUCER TIP VORTEX SUPPRESSOR

FIELD OF THE INVENTION

This invention relates generally to fluid motivation and, more specifically, to fluid inducer technology.

BACKGROUND OF THE INVENTION

Inducers are typically utilized as the first pumping element of centrifugal and axial flow pumps to lower the inlet pressure at which cavitation results in pump head (discharge pressure) loss. Inducers include blades that are designed to operate in a passage with a small positive incidence angle between the fluid angle relative to a blade pressure side angle as the fluid enters an area between the operating blades know as a blade row. A tip clearance between the blade tip and a wall of the passage is necessary to allow the blade tip to operate within the passage.

Camber is then added to blade geometry after the fluid is captured in the blade row to add work to the fluid raising its tangential velocity and static pressure. The small positive incidence angle near the blade tip is selected based on the gross uniform axial velocity. Because of boundary layer losses and a back flow at the blade tip that flows through the tip clearance, the actual incidence angle relative to fluid in the tip clearance is larger due to the momentum exchange and mixing resulting in lower axial velocity of the fluid. The larger incidence angle results in a larger differential pressure across the blade tip near the leading edge, which, in turn, results in larger back flow through the tip clearance. This dynamic feedback mechanism develops a queasy steady state condition at most inlet pressure and flow rate vs. operating speed conditions.

At operating speed, the velocity of the back flow through tip clearance is sufficient to lower the local static pressure below the fluid vapor pressure resulting in vapor bubbles forming in the high velocity region, which collapse as the velocity is dissipated, and the local static pressure increases. Dynamic instability including higher order rotating cavitation (HORC) and higher order surge cavitation (HOSC) appear as pressure oscillations at inlet pressures. HOSC and HORC, occur when the tip vortex (tip clearance) cavitation cavity is approximately equal to 65% of the blade spacing at the blade tip. The frequency of the higher order oscillations are typically on the order of 5 to 8 times shaft speed, depending on the number of inducer blades and other features that make-up the inducer geometry. The dynamic instability only occurs within a limited flow rate verses speed range, which suggests that it is incidence angle sensitive. At low flow rates, the incidence angle is large resulting in a large cavitation cavity at all inlet conditions. At high flow rates, the incidence angle is small resulting in a small cavitation cavity at all inlet conditions.

Head break down results from blockage due to the cavitation sheet that originates on the suction side of the blade leading edge when the local static pressure falls below the propellant vapor pressure. Leading edge cavitation sheets typically progress from alternate blade cavitation to rotating blade cavitation to gross head loss as the inlet pressure is decreased. Problems associated with these characteristics are avoided by maintaining the margin on break down conditions. The HOSC and HORC are not a result of the cavitation sheet that springs from the blade leading edge, but are instead a function of the tip clearance back flow and the tip vortex cavitation cavity length.

As a result, there is an unmet need in the art to minimize the tip vortex cavitation cavity by suppressing the back flow through the tip clearance.

SUMMARY OF THE INVENTION

Embodiments of the invention provide a method, device, and turbopump configured to suppress higher order cavitations at an inducer tip in a turbopump. An inducer having a tip is rotated, and a first flow (pump through flow) is induced axially through the inducer at a first axial velocity. An annular fluid flow is introduced axially toward a tip clearance of the inducer substantially parallel to the first fluid flow at a second axial velocity that is greater than the first axial velocity, such that back flow through the tip clearance of the inducer is reduced.

A presently preferred embodiment of the invention includes a rearward-facing step located just upstream of the blade tip leading edge with a radial height equal to or slightly greater than the blade tip clearance. The rearward-facing step can be accomplished by making the inlet duct equal to the inducer diameter or by introducing a gradual convergent section in the duct up stream of the step. An annular flow passage is located in the rearward-facing step to direct an annulus of axial flow along the inducer tunnel into the inducer blade tip clearance. A manifold is provided to supply the flow to the annular flow passage at the required flow rate and velocity. Flow is supplied to the suppressor manifold from a down stream source of sufficient pressure to provide the desire flow rate. Depending on the tip clearance, the flow rate required to decrease the incidence angle to approximately zero will be one to two percent of the inducer through-flow. The required velocity to reduce the incidence angle to approximately zero will be 1.5 to 2.0 times the through-flow axial velocity, depending on the inducer design. Introducing a higher velocity axial flow directed at the blade tip clearance decreases the tip incidence angle to approximately zero which eliminates the tip clearance back flow and incidence angle variation.

In accordance with an aspect of the invention, the second fluid flow is introduced annularly into the tip clearance flow region. Further, the second fluid flow is introduced in an axial flow direction. Also, the second velocity may be approximately equal to the fluid velocity required to reduce the fluid incidence angle relative to the blade pressure side angle to zero.

In accordance with still another aspect of the invention, the second flow is directed to energize a boundary layer flow. Advantageously, the energizing of the boundary layer flow is sufficient to eliminate a tip clearance back flow by optimizing the effective incidence angle at the inducer tip.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, embodiments of the invention provide a method, device, and turbopump configured to suppress higher order cavitations at an inducer tip in a turbopump. An inducer having a tip is rotated at a tangential velocity and a first flow is induced axially through the inducer at a first axial velocity. A second fluid flow is introduced toward the tip clearance of the inducer substantially parallel to the first fluid flow at a second axial velocity that is greater than the first axial velocity, such that back flow through the tip clearance of the inducer is reduced.

Figure 1:
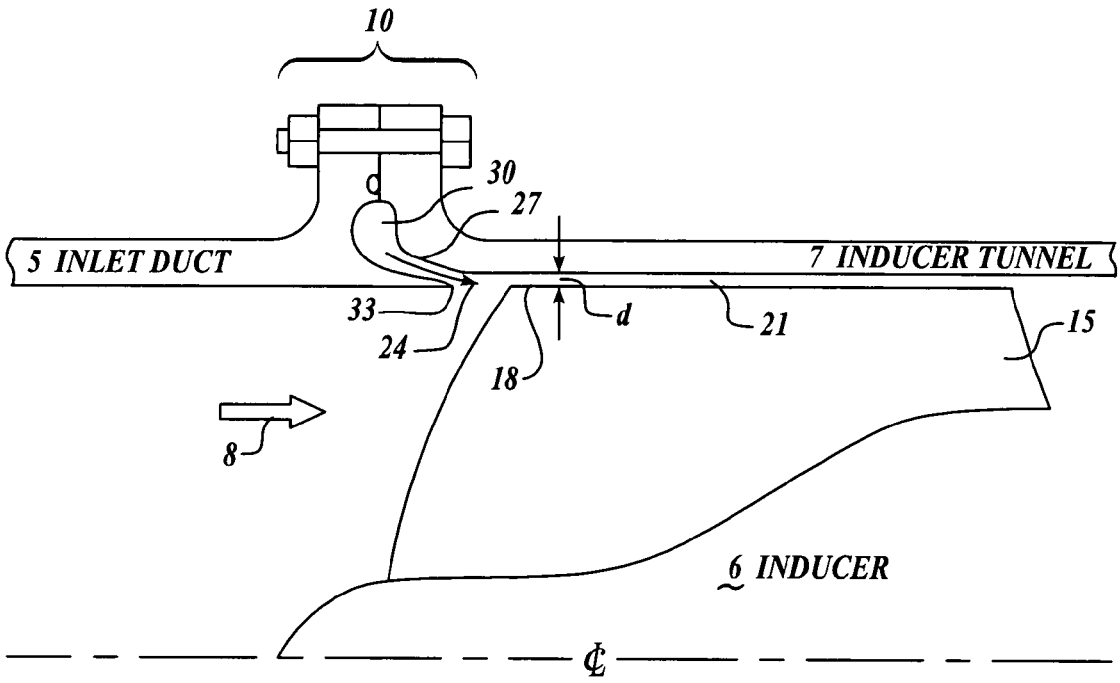
FIG. 1 is a detailed cross-section view of an inducer housed in an inducer tunnel with the inlet duct and tip vortex suppressor upstream of the inducer.

Referring to FIG. 1, an inlet duct 5 housing an inducer 6 in an induction tunnel housing 7 that includes a vortex suppressor assembly 10. To induce a first fluid flow 8 of fluid through an induction tunnel housing 7, an inducer blade 15 having an inducer blade tip 18 is rotated in the induction tunnel housing 7. The inducer blade 15 rotates in the induction tunnel housing 7 with an inducer tip clearance 21 with an inducer tip clearance distance d between the induction tunnel housing 7 and the inducer blade tip 18.

To suppress high order oscillations, the vortex suppressor 10 defines an annular manifold 30. The annular manifold 30 includes an annular vent 27 to direct a second fluid flow 24 generated by conducting fluid from the annular manifold 30 to the inducer tip clearance 21 substantially parallel to the first fluid flow 8.

The annular vent 27 is defined by the inlet duct 5 to direct the second fluid flow 24 into the tunnel housing 7 through a rearward-facing step 33 with a radial thickness that is equal to or greater than the dimension d. The step 33 overlays the inducer tip clearance 21 in a manner to occlude the inducer tip clearance 21 from the first fluid flow 8 thereby introducing, instead, the second fluid flow 24 to fill the inducer tip clearance 21.

Referring to FIGS. 1, 2*a*, 2*b*, and 2*c*, a vector equation describes the inducer blade tip 18 as it attacks the second fluid flow 24 in the inducer tip clearance 21. The magnitude of higher order oscillation relates to the magnitude of an incidence angle $\alpha$.

The magnitude of incidence angle $\alpha$ is a function of the magnitude and direction of each of a fluid axial velocity 39 ($V_A$), a blade tip tangential velocity 42 ($V_T$), and a pressure side blade angle $\beta$. The incidence angle $\alpha$, is defined by the relationship:

$$\alpha=\beta-\theta \tag{1}$$

where blade angle $\beta$ is an angle of a blade pressure side surface and fluid relative angle $\theta$. The blade pressure side surface, in this case is the leading surface of the inducer blade 15 at the inducer blade tip 18 traveling with a tangential velocity $V_T$. The blade angle $\beta$ is established by the blade geometry with reference to the blade tip tangential velocity 42 ($V_T$). The fluid relative angle $\theta$ is an angle expressing the relationship between the fluid axial velocity 39 ($V_A$) and blade tip tangential velocity 42 ($V_T$) and is defined as:

$$\tan\theta = \frac{V_A}{V_T} \tag{2}$$

The incidence angle $\alpha=\beta-\theta$ is typically selected to be a small positive value to optimize the suction performance and is generally based on an assumption of a uniform axial flow velocity $V_A$ across the inducer blade 15. Prior industry practice has allowed no accounting for boundary layer effects but rather has designed with optimization of the greatest part of the inducer blade 15 in mind.

Figure 2A:
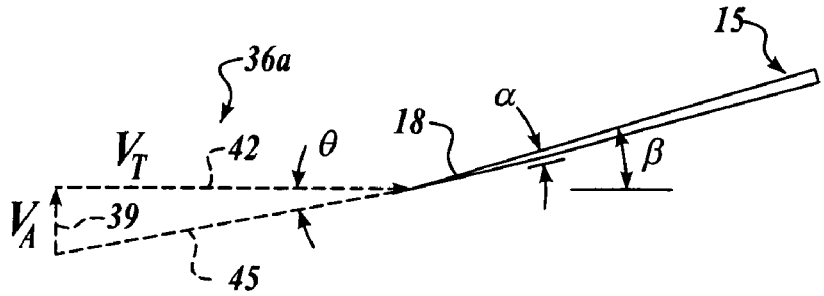
FIG. 2*a* is a vector diagram of a flow at the inducer tip where the relative velocity of the flow, based on the through flow, nearly aligns with the blade angle.

FIG. 2*a* is a vector diagram 36*a* of the fluid flow at the inducer tip at based on a uniform through flow velocity 39*a*, i.e. where the fluid velocity relative to the blade 45 nearly aligns with the blade angle. Because the relationship between the fluid axial velocity 39*a*, set forth as $V_A$, to the blade tip tangential velocity 42, set forth as $V_T$, determines the fluid velocity relative to the blade 45. The fluid velocity relative to the blade 45 determines the fluid relative angle $\theta$ that is sufficiently aligned with blade angle $\beta$ thereby preventing a significant backflow.

Figure 2B:
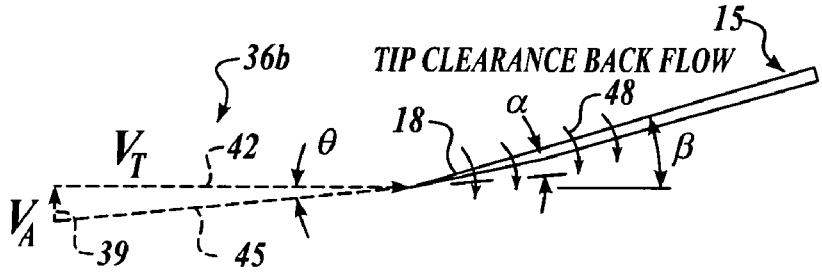
FIG. 2*b* is a vector diagram of a flow at the inducer tip where the relative velocity of the flow departs significantly from the blade angle due to boundary layer flow and tip clearance back flow.

FIG. 2*b* is a vector diagram 36*b* of the fluid flow at the inducer tip where the tip clearance back flow is mixed with the first flow 8 boundary layer lowering the axial velocity 39*a* ($V_A$) at the blade tip such that the fluid velocity relative to the blade 45 is not aligned with the inducer blade 15 resulting in a larger incidence angle $\alpha$. As the magnitude of the incidence angle $\alpha$ increases so too does the occurrence of HOSC and HORC.

Figure 2C:
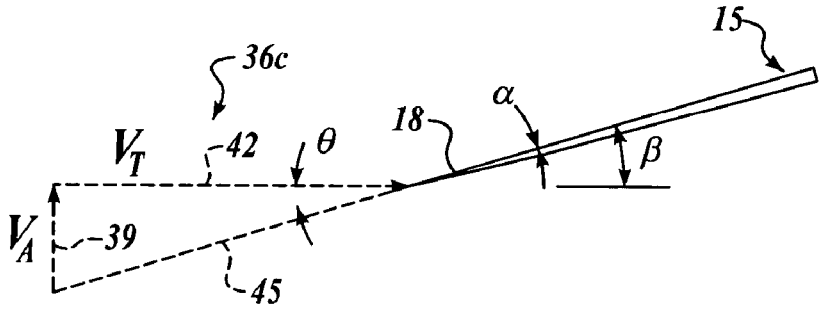
FIG. 2*c* is a vector diagram of flows at the inducer tip where the relative velocity of the flow is optimized to align with the blade angle by introducing suppressor flow.

FIG. 2*c* is a vector diagram 36*c* of flows at the inducer tip where the relative velocity of the flow is optimized to align with the blade angle $\beta$. In FIG. 2*c*, a second fluid flow 24 is introduced with an axial velocity 39*b* ($V_A$) sufficient to overcome boundary layer effects such that the fluid velocity relative to the blade 45 aligns with the blade and, thereby, reduces the incidence angle $\alpha$ to zero. Tip vortex suppressor flow 24 with an axial velocity 39*c* ($V_A$) is selected to decrease the incidence angle $\alpha$ to zero by increasing the magnitude of fluid relative angle $\theta$ to equal that of the blade angle $\beta$. As the magnitude of the incidence angle $\alpha$ approaches zero, differential pressure across the blade tip reduces and substantially eliminates back flow 48.

Figure 3:
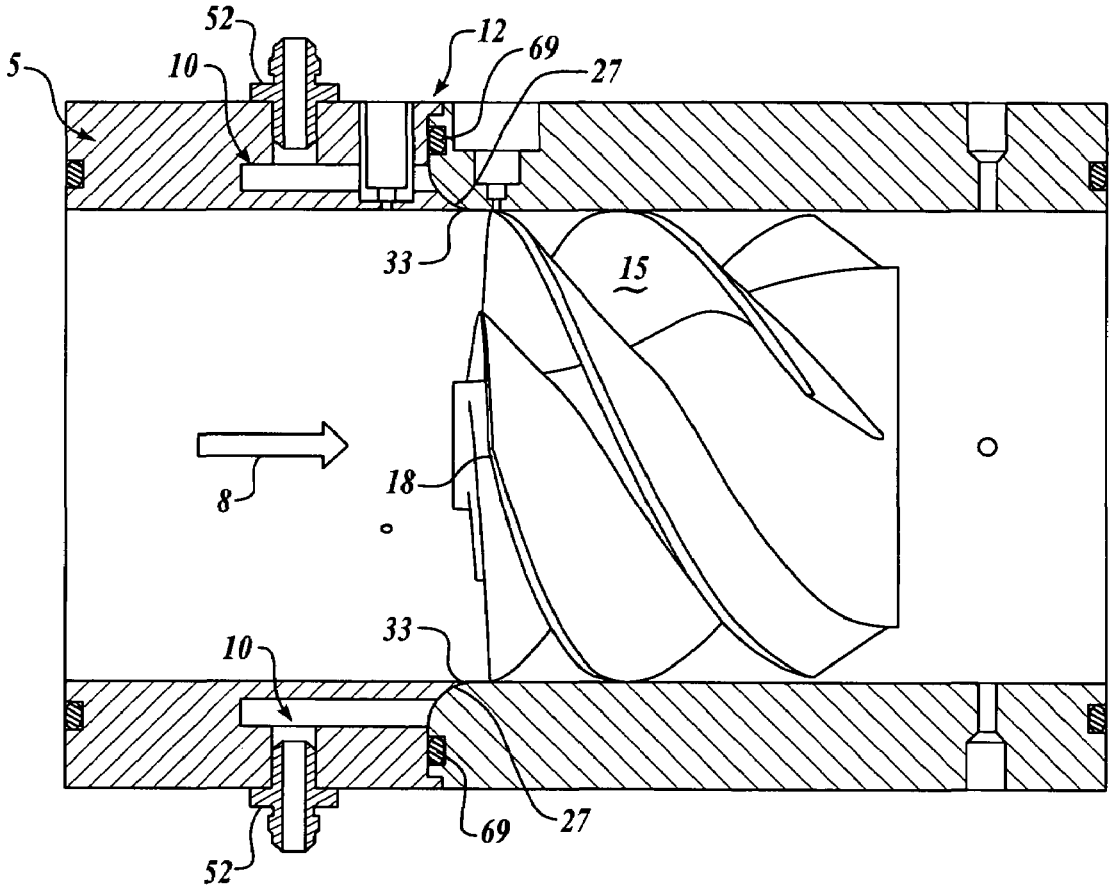
FIG. 3 is a cross-section view of an inducer assembly with the inlet duct and suppressor.

Referring to FIG. 3, the first flow of fluid 8, flows past the inducer blade 15 in a presently preferred embodiment of the invention. The vortex suppressor 10 is arranged as a continuous annular vent 27 defined between the inlet duct 5 and the inducer tunnel housing 7. The rearward facing step 33 defines the annular vent 27 separating the inlet duct 5 from the inducer tunnel 7. For purposes of fabrication the inlet duct 5 may be formed apart from the induction tunnel 7 and joined with an annular seal 69 at the junction of the inlet duct 5 and the inducer tunnel 7. In a presently preferred embodiment, a series of fittings 52 is placed at intervals around the suppressor manifold 30. Advantageously, fluid supplied at the fittings exhausts through the vent 27 evenly behind the rearward facing step 33 to energize the boundary layer (not pictured). The inducer tips 18 smoothly enters the energized boundary layer incidence angle $\alpha$ approaching zero the inducer blade 15 rotates in the inducer tunnel housing 7 thereby suppressing high order oscillations at the inducer blade tips 18.

Figure 4:
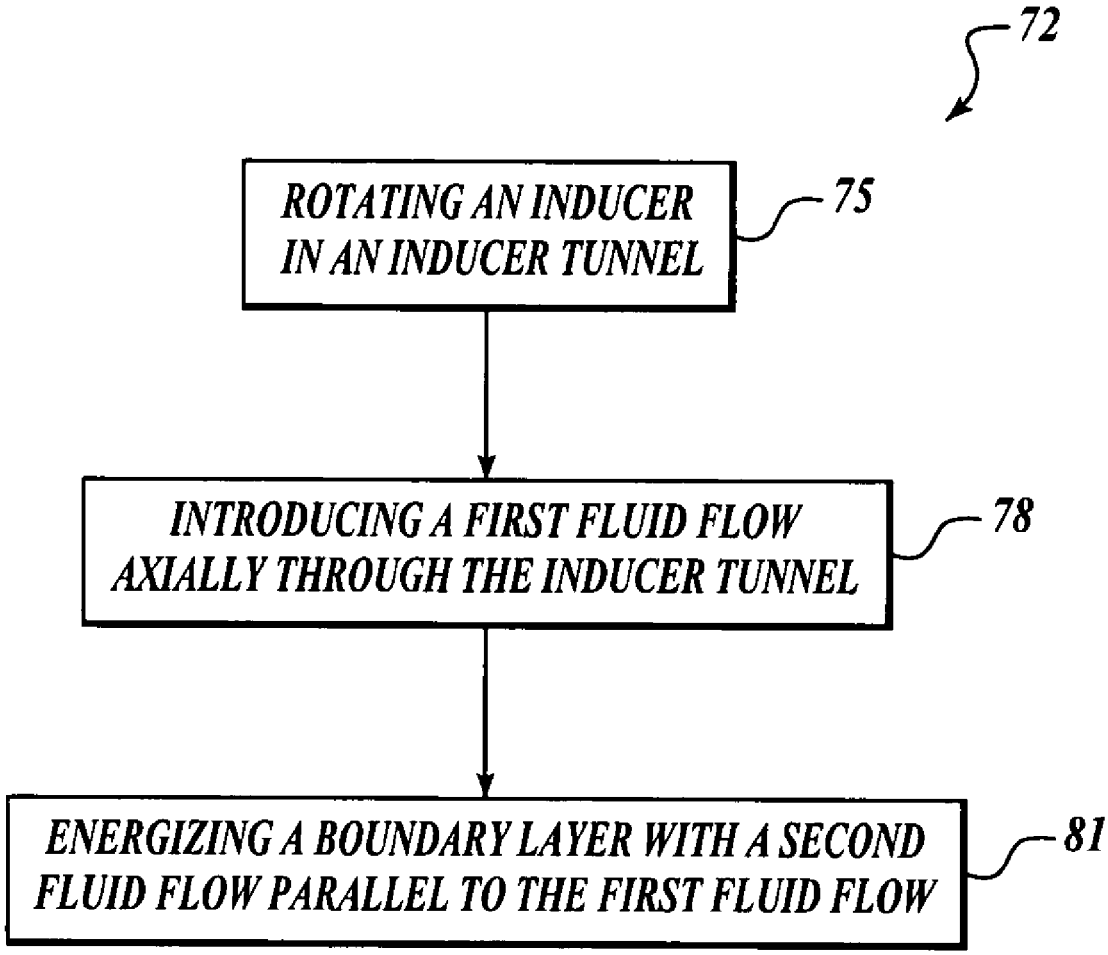
FIG. 4 is a flow chart of a method for suppressing high order oscillations.

Referring to FIG. 4, a method 72 is used to suppress cavitation at an inducer tip. An inducer pump moves a fluid and the inducer includes an inducer tunnel as discussed above.

At a block 75, the inducer is rotated in the inducer tunnel. At a block 78, a flow of fluid is introduced. Inclined blades of the rotating inducer receive the fluid and as the inducer rotates, the fluid is propelled axially through the inducer blades. The movement of the fluid upstream of the inducer in the inlet duct defines a boundary layer in which the viscosity of the fluid causes the flow of the fluid to slow in proximity to a wall of the duct. The slowing of the fluid in the boundary layer causes cavitation at the inducer blade tip at suitably high rotational speeds.

At a block 81, a second flow of fluid is introduced into the boundary layer. The second flow of fluid energizes the boundary layer by being introduced at an axial velocity in excess of the first flow velocity thereby overcoming the slowing of the boundary layer. By observing the presence of the cavitation at the inducer blade tips, generally evidenced by high order oscillation, the speed of the second fluid flow can be optimized to minimize cavitation. Generally, introducing the second fluid flow at a velocity to reduce the fluid incidence angle relative to the blade to zero will suitably suppress the cavitation at the inducer blade tip.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A method for suppressing cavitation at an inducer blade tip in a pump, the method comprising:

rotating an inducer having a tip clearance;

inducing a first fluid flow axially through the inducer at a first velocity; and introducing a second fluid flow toward the tip clearance substantially parallel to the first fluid flow at a flow rate with a second velocity, greater than the first velocity, such that back flow through the tip clearance of the inducer is reduced, wherein introducing the second fluid flow includes introducing the second fluid flow through a substantially cylindrical housing having a rearward-facing step configured to introduce the second fluid flow toward the tip clearance of the inducer.

2. The method of claim 1, wherein the second fluid flow is introduced into a boundary layer.

3. The method of claim 2, wherein introducing the second fluid flow includes occluding the first fluid flow from the tip clearance.

4. The method of claim 1, wherein the second velocity is substantially 1.5 to 2 times the first velocity.

5. The method of claim 1, wherein the second velocity is selected to minimize the relative fluid angle.

6. The method of claim 1, further comprising directing the second flow to energize a boundary layer flow.

7. The method of claim 6, wherein the energizing of the boundary layer flow is sufficient to eliminate a tip back flow near the leading edge.

8. The method of claim 6, wherein directing of the second flow includes directing to optimize the effective incidence angle at the inducer tip.

9. A device for suppressing cavitation at an inducer blade tip in a pump, the device comprising:

a substantially cylindrical housing configured to receive an inducer therein, the inducer being configured to induce a first fluid flow axially through the housing at a first velocity; and an inductor configured to introduce a second fluid flow at a flow rate toward a tip clearance of the inducer substantially parallel to the first fluid flow at a second velocity that is greater than the first velocity, such that back flow through the tip clearance of the inducer is reduced, wherein the substantially cylindrical housing further defines a rearward-facing step configured to introduce the second fluid flow toward the tip clearance of the inducer.

10. The device of claim 9, wherein the second fluid flow is introduced into a boundary layer flow along an inner wall of the cylindrical housing.

11. The device of claim 9, wherein the inductor includes an inlet duct.

12. The device of claim 11, wherein the inlet duct is configured to introduce the second fluid flow at a direction substantially parallel to the first fluid flow.

13. The device of claim 12, where the inlet duct is further configured to introduce the second fluid flow at the flow rate into a tip clearance.

14. The device of claim 9, wherein the second velocity is substantially 1.5 to 2 times the first velocity.

15. The device of claim 9, wherein the flow rate is substantially equal to a tip clearance potential flow rate.

16. The device of claim 9, wherein the flow rate is optimized to minimize the tip vortex.

17. The device of claim 9, wherein the flow rate is optimized to minimize higher order oscillations.

18. The device of claim 9, wherein the second flow energizes a boundary layer substantially along the inner wall.

19. The device of claim 9, wherein the rearward facing step includes an annular slot at the step.

20. An inducer axial flow stage for a pump, the inducer axial flow stage comprising:

an inducer having blades tangentially arranged about an axis, the blades having an outer tip, a pressure side, a suction side, a blade entrance angle and camber to motivate a first flow of a fluid at a first velocity upon rotation of the inducer; and a housing defining a tunnel, the tunnel being coaxial with the inducer axis and having a cylindrical wall spaced apart from the outer tip of the blades, an upstream opening, and a downstream opening, the tunnel being configured to contain the inducer between the upstream opening and the downstream opening in a plane perpendicular to the axis, the cylindrical wall further defining an annular slot substantially at a juncture of the cylinder inner wall and the inducer blade tips, wherein the cylindrical wall further defines a step at the annular slot, the step extending toward the downstream opening, the step being configured to occlude the tip clearance.

21. The pump of claim 20, wherein the cylindrical wall is spaced apart from the outer blade tip to define a tip clearance.

22. The pump of claim 20, wherein the annular slot is configured to introduce a second flow of fluid at a flow rate.

23. The pump of claim 22, wherein the second flow energizes a boundary layer substantially at the cylindrical wall.

24. The pump of claim 22, wherein the second velocity is at a second velocity substantially parallel to the axis.

25. The pump of claim 24, wherein the second velocity is selected to minimize reverse flow at the tip clearance.

26. The pump of claim 24 wherein the second velocity is optimized to reduce a relative fluid angle.

27. The pump of claim 24, wherein the flow rate is optimized to minimize a tip vortex.

28. The pump of claim 24, wherein the flow rate is optimized to minimize higher order oscillations.

* * * * *